US010015583B2

(12) United States Patent
Arneson et al.

(10) Patent No.: US 10,015,583 B2
(45) Date of Patent: Jul. 3, 2018

(54) ARRAYABLE LOUDSPEAKER WITH CONSTANT WIDE BEAMWIDTH

(71) Applicant: Meyer Sound Laboratories, Incorporated, Berkeley, CA (US)

(72) Inventors: Jon M. Arneson, Napa, CA (US); Katrin Rawks, El Cerrito, CA (US); Pablo Espinosa, Pleasanton, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 0 days.

(21) Appl. No.: 15/099,474

(22) Filed: Apr. 14, 2016

(65) Prior Publication Data

US 2017/0013348 A1 Jan. 12, 2017

Related U.S. Application Data

(60) Provisional application No. 62/147,553, filed on Apr. 14, 2015.

(51) Int. Cl.
*H04R 9/08* (2006.01)
*H04R 1/24* (2006.01)
(Continued)

(52) U.S. Cl.
CPC ..... *H04R 1/24* (2013.01); *H04R 1/2865* (2013.01); *H04R 1/403* (2013.01); *H04R 3/14* (2013.01); *H04R 2203/12* (2013.01)

(58) Field of Classification Search
CPC ..... H04R 1/24; H04R 1/28656; H04R 1/403; H04R 3/14; H04R 2203/12
(Continued)

(56) References Cited

U.S. PATENT DOCUMENTS 3,892,288 A 7/1975 Klayman et al.
5,163,167 A 11/1992 Heil
(Continued)

FOREIGN PATENT DOCUMENTS

WO PCT/US16/27618 7/2016

OTHER PUBLICATIONS

"T10 Loudspeaker", Webpage product description, d&b audiotechnik, Jun. 2, 2014.
(Continued)

*Primary Examiner* — Sunita Joshi
(74) *Attorney, Agent, or Firm* — Beeson Skinner Beverly, LLP

(57) ABSTRACT

An arrayable loudspeaker (11) has at least one high frequency driver (39) mounted to a horn (37) and at least one pair of low frequency drivers (41) configured behind and in a closely spaced relationship to the horn to form low frequency side chambers (71) between the drivers and the horn from which acoustic energy produced by the low frequency drivers can propagate. Low frequency exit channels (77) above and below the horn are coupled to the low frequency side chambers (71). The configuration of the horn and low frequency drivers and the low frequency side chambers and low frequency exit channels is such that acoustical outputs of all drivers radiate coaxially from the loudspeaker with substantially constant wide beamwidth in the non-arraying plane. Signal processing can be added to enhance beamwidth control critical frequency ranges above crossover.

18 Claims, 14 Drawing Sheets

(51) Int. Cl.
*H04R 1/40* (2006.01)
*H04R 1/28* (2006.01)
*H04R 3/14* (2006.01)

(58) Field of Classification Search
USPC ..... 381/387, 342, 339, 349
See application file for complete search history.

(56) References Cited

U.S. PATENT DOCUMENTS

| | | | | |
|---|---|---|---|---|
| 5,590,214 | A | 12/1996 | Nakamura | |
| 6,081,602 | A | 6/2000 | Meyer et al. | |
| 6,411,718 | B1 | 6/2002 | Danley et al. | |
| 6,668,969 | B2 | 12/2003 | Meyer et al. | |
| 7,275,621 | B1 | 10/2007 | Delgado, Jr. | |
| 2003/0209384 | A1* | 11/2003 | Dalbec ..... | G10K 11/025 181/182 |
| 2006/0062402 | A1 | 3/2006 | Heil | |
| 2009/0136072 | A1 | 5/2009 | Danley | |
| 2009/0214067 | A1 | 8/2009 | Bothe | |
| 2010/0014697 | A1 | 1/2010 | Thompson | |
| 2015/0086057 | A1* | 3/2015 | Christner ..... | H04R 1/2819 381/349 |

OTHER PUBLICATIONS

Lange, Thomas Dr., Letter to Beeson Skinner Beverly, LLP from Lambsdorff & Lange Patentanwalte, Jan. 30, 2017.
"Hi-Fi Audio Drivers (Speakers and Tweeters)", DIYAudioProjects webpage, May 8, 2014.
Specification Sheet, L-Acoustics, KARA Modular Line Source, Date unknown.
Specification Sheet, Eastern Acoustic Works, QX326, Date unknown.
Webpage product description, d&b audiotechnik, T10 Loudspeaker, Date unknown.
Data Sheet, MICA Loudspeaker, Meyer Sound Laboratories, Incorporated, 2005.
Data Sheet, MINA Loudspeaker, Meyer Sound Laboratories, Incorporated, 2010.
Webpage product description, Eastern Acoustic Works (EAW), QX Series Loudspeaker, Jun. 2006.
Product Specification, Fulcrum Acoustic, XL Horn-Loaded Coaxial Loudspeaker, 2009.
Product Specification Sheet, JBL, VTX V20 Loudspeaker, 2015.
PSW Staff, "d & b audiotechnik Debuts P-Series-Line Array & Point Source in One Package", 3 pages, Feb. 4, 2009, Pro Sound Web, http://www.prosoundweb.com/article/db_audiotechnik_debuts_t_series_line_array_point_source_in_one_package/.†
"The T-Series" Manual, 23 Pages, Mar. 2009, d & b audiotechnik GmbH, Frankfurt am Main, Germany, with page numbers and Fig numbers.†
"The T-Series" Manual, 23 Pages, Mar. 2009, d & b audiotechnik GmbH, Frankfurt am Main, Germany.†
D & B Audio Technik, T10 Loudspeaker, 6 pages, Jun. 2, 2014, https://web.archive.org/web/20140602022519/http://www.dbaudio.com/en/systems/details/t10--loudspeaker.html.†

* cited by examiner
† cited by third party

ARRAYABLE LOUDSPEAKER WITH CONSTANT WIDE BEAMWIDTH

CROSS-REFERENCE TO RELATED APPLICATIONS

This application claims the benefit of U.S. Provisional Patent Application No. 62/147,553 filed Apr. 14, 2015, which is incorporated herein by reference.

BACKGROUND

The present invention generally relates to arrayable loudspeaker systems and more particularly to the control of the beamwidth of an arrayed loudspeaker system in the non-arraying plane.

The beamwidth of a loudspeaker determines its coverage. The problem encountered in conventional loudspeakers designed to produce wide beamwidths is that the beamwidth is not stable or constant over the operating frequency range of the loudspeaker, and particularly at mid to low frequencies at and below crossover. A loudspeaker that has a constant beamwidth over its operating frequencies will cover the audience predictably and evenly, with well-defined roll-off points and minimal energy projected beyond the roll-off points. The sound will be the same throughout the loudspeaker's coverage area; it will be as clear and full near the edges of coverage as it is in front of the loudspeaker. Outside the beamwidth, that is, the loudspeaker's coverage pattern, there is very little acoustic energy to excite the reverberant field or cause destructive interference from indoor reflections. And in outdoor venues and festivals there is reduced "spillover" to adjacent stages or nearby residential areas.

In compact multi-way loudspeaker systems, it is difficult to achieve constant wide beamwidth from multiple transducers. Existing attempts involve tradeoffs in cabinet size, distortion, lobing, excessive pattern narrowing, and/or phase issues. These include

- placing cone drivers and waveguide(s) (horn(s)) next to each other—this can result in off-axis narrowing and lobing at crossover frequencies;
- mounting multiple transducers/horns coaxially—can result in inconsistent beamwidths; forces compromises in transducer/waveguide designs;
- making the horn very narrow to push cone drivers closer together—this compromises HF driver loading and/or beamwidth consistency;
- cutting openings in the horn walls for rear-mounted drivers—this compromises LF output or HF driver loading and/or coverage pattern; and
- using a single large horn fed by all drivers—this requires much larger enclosure for comparable LF extension and/or efficiency.

SUMMARY OF INVENTION

The arrayable loudspeaker system of the present invention avoids these tradeoffs. The invention provides for an arrayable loudspeaker system with broadband pattern control along with adequate compression driver loading, even at relatively low crossover frequencies. The horn mouth dimensions must be quite large in order to achieve this, yet the resulting low driver shadowing issues are substantially eliminated. The issues inherent in other designs—off-axis lobing, inconsistent beamwidth, and inadequate compression driver loading—are substantially eliminated.

In the crossover region where the horn and cones both contribute to the overall acoustical output, the nominal horizontal beamwidth is maintained due to the nearly identical acoustic centers of the transducers afforded by the LF exit channels at these frequencies. The summed phase response of the transducers through the crossover region is also unchanged at any angle within the loudspeaker's nominal coverage angle. The result is an impulse response that is spatially consistent and thus a loudspeaker that sounds the same throughout the listening area.

The invention further benefits the arrayable loudspeaker—specifically the line array element—by minimizing cabinet width without sacrificing LF transducer diameter and hence LF efficiency and maximum output. The market demands smaller, lighter, more powerful sound systems, yet overall cabinet size and LF output are generally linked. LF performance can now be maintained from a significantly narrower cabinet, greatly improving audience sightlines with no reduction in performance.

The arrayable loudspeaker of the invention includes a cabinet having top, bottom and side walls forming an enclosure. The cabinet further has a front with a front opening and a center axis passing through the front opening. A horn mounting structure is provided in the cabinet on the center axis of the enclosure behind the enclosure's front opening, and a horn for a high frequency transducer is mounted to the horn mounting structure in the cabinet.

The horn has a front perimeter portion defining a mouth end, a throat end, flared sidewalls extending from the throat end to the mouth end, and a top wall and a bottom wall extending between the sidewalls; the horn further has an axis extending from the throat end of the horn through the horn's mouth end which defines a propagation axis. The front perimeter portion of the horn includes side perimeter edges, a top perimeter edge and a bottom perimeter edge.

The horn is mounted to the horn mounting structure in the enclosure such that the horn's propagation axis substantially aligns with the center axis of the enclosure, and such that the mouth end of the horn is positioned at the front opening of the enclosure. The mouth end of the horn is smaller than the front opening of the enclosure such that side chamber openings are created at the front opening of the enclosure adjacent the mouth end of the horn, and such that top and bottom gaps are created at the front of the enclosure above and below the top and bottom perimeter edges of the horn's front perimeter portion. A high frequency transducer mounted to the throat end of the horn.

Low frequency transducer mounting structures are positioned in the enclosure behind the front opening of the enclosure on opposite sides of the horn mounting structure. At least one forward facing low frequency transducer is mounted to each of the low frequency transducer mounting structures such that the low frequency transducers are positioned in the enclosure on opposite sides of the horn at a predetermined forward facing angle relative to the propagation axis of the horn. Each forward facing low frequency transducer faces a flared sidewall of the horn and one of the side chamber openings at the front of the cabinet.

The low frequency side chambers, which contain a volume of air, are formed between the forward facing low frequency transducers and the flared sidewalls of the horn, and are coupled to atmosphere through the side chamber openings at the front opening of the enclosure adjacent the mouth end of the horn. Low frequency exit channels are formed above the top wall of the horn and below the bottom wall of the horn, and have at least the following characteristics:

they have a volume for containing a volume of air, they extend from about the horn's support structure to the gaps at the front of the enclosure above and below the top and bottom perimeter edges of the horn's front perimeter portion, they couple to the low frequency transducer side chambers, and they couple to atmosphere through the top and bottom gaps above and below the top and bottom perimeter edges of the horn's front perimeter portion.

In another aspect of the invention, the loudspeaker further comprises correction circuit means, including a crossover circuit, for the high and low frequency transducers. This correction circuit, which can be an analog circuit or implemented by DSP techniques, compensates for beamwidth distorting effects within an affected frequency range above the crossover frequency range. The beamwidth distorting effects that are compensated for are caused by residual acoustic energy propagated from the horn in the affected frequency range that is captured by and reflected from the low frequency side channels formed between the horn and low frequency transducers.

Other aspects of the invention will be apparent from the following specification and claims and the accompanying drawings.

DETAILED DESCRIPTION

As used herein "low" and "high" to denote frequency ranges are understood to be relative terms that encompass mid-frequency ranges where crossover from low to high frequencies occurs. For example, when referring to a "low frequency" transducer (sometimes referred to herein as "driver"), it will be understood that the transducer will operate at frequencies below crossover and at frequencies extending up into the crossover frequency range. Similarly, when referring to a "high frequency" transducer, it will be understood that the transducer will operate at frequencies that extend down into the crossover frequency range as well as frequencies above crossover. Also, the characterization of a transducer as "high" or "low" does not preclude the possibility that the transducer could produce some acoustic energy outside of its normal operating frequency range, as is discussed below in connection with the low frequency transducers of the loudspeaker described herein.

An arrayable loudspeaker is described which is comprised of at least one high frequency transducer, such as a compression driver, mounted to a waveguide (horn) and at least one pair of low frequency transducers (drivers) configured in a closely spaced arrangement such that all transducer acoustical outputs radiate coaxially from the loudspeaker with substantially constant wide beamwidth in the non-arraying plane. In the illustrated embodiment hereinafter described, the loudspeakers are arrayed in the vertical plane where the beamwidth control occurs in the horizontal plane. However, it will be understood that the inventions could as well be implemented using horizontally arrayable loudspeakers, in which case the constant beamwidth control would occur in the vertical plane.

Figure 1:
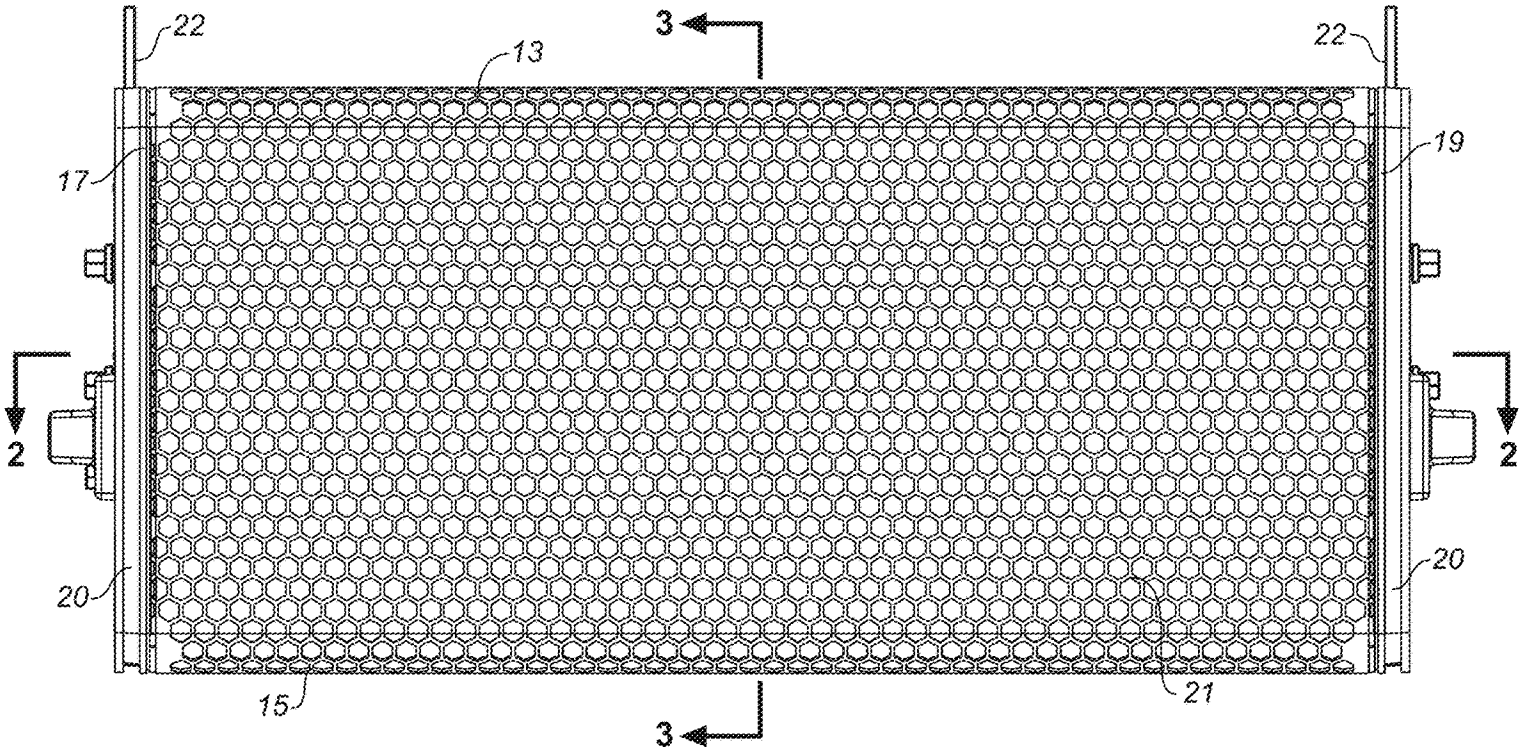
FIG. 1 is a front elevational view of an arrayable loudspeaker in accordance with the invention.
Figure 2:
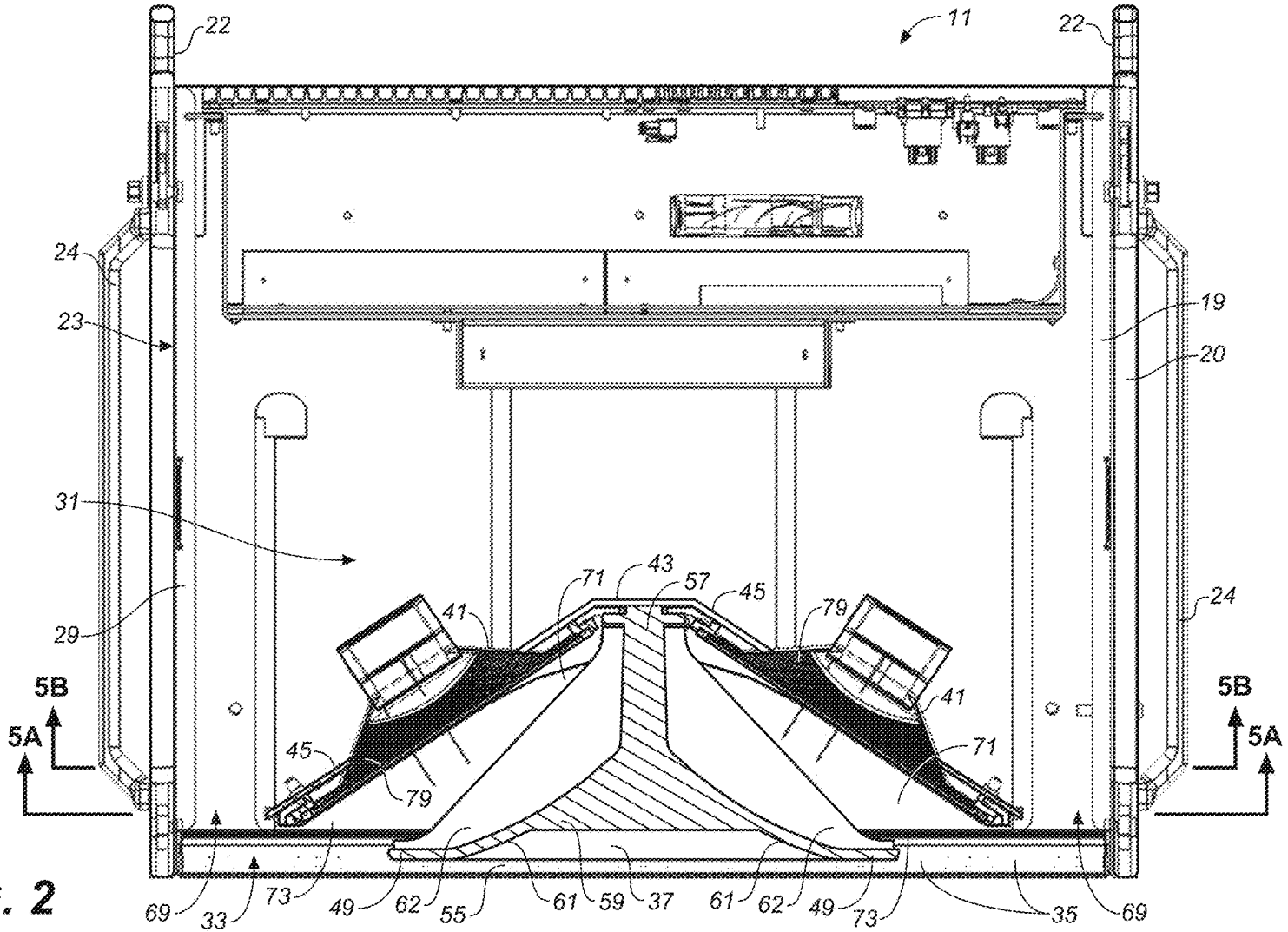
FIG. 2 is a cross-sectional view thereof taken along lines 2-2 in FIG. 1.
Figure 2A:
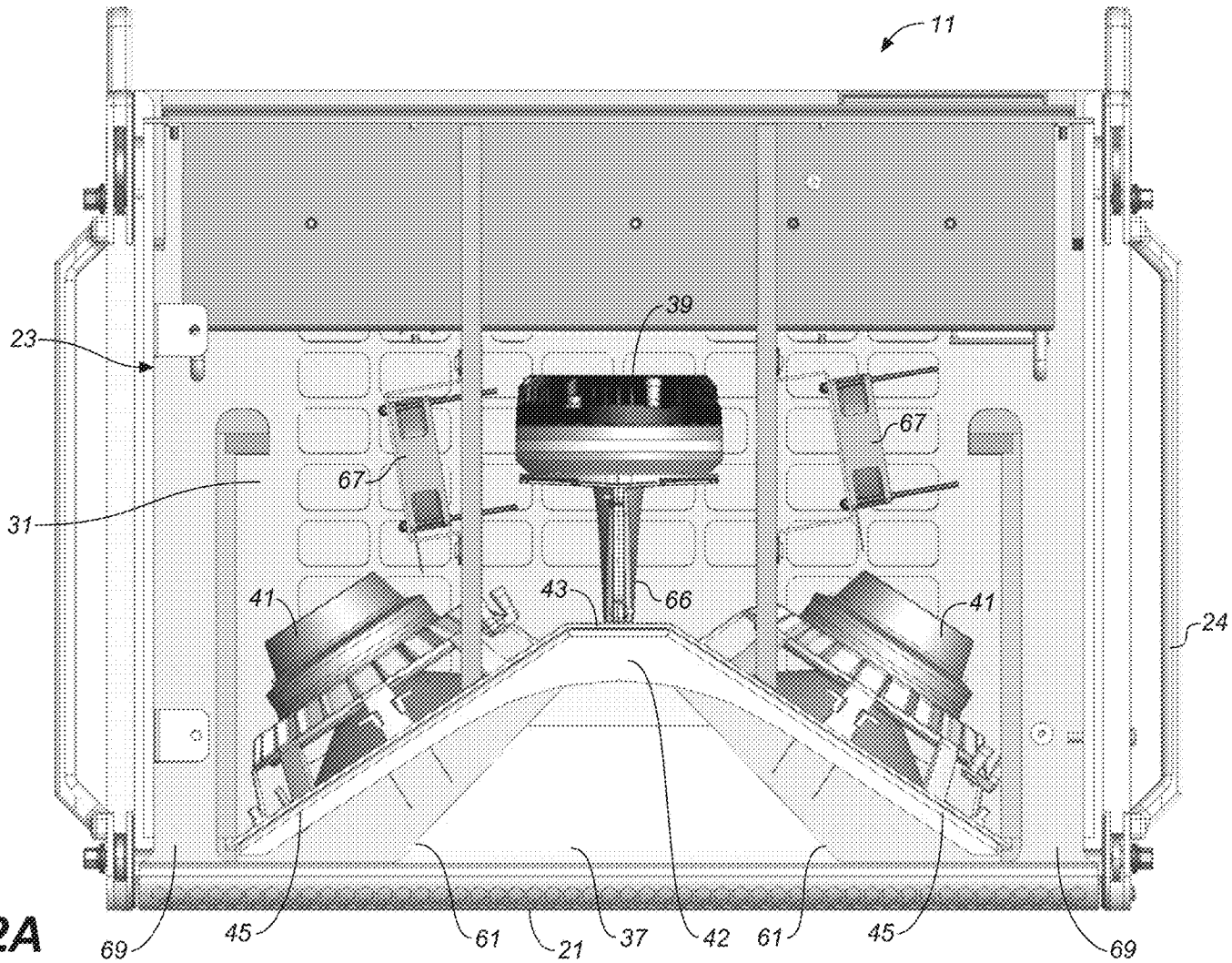
FIG. 2A is a top plan view thereof with the top of the loudspeaker cabinet removed.
Figure 2B:
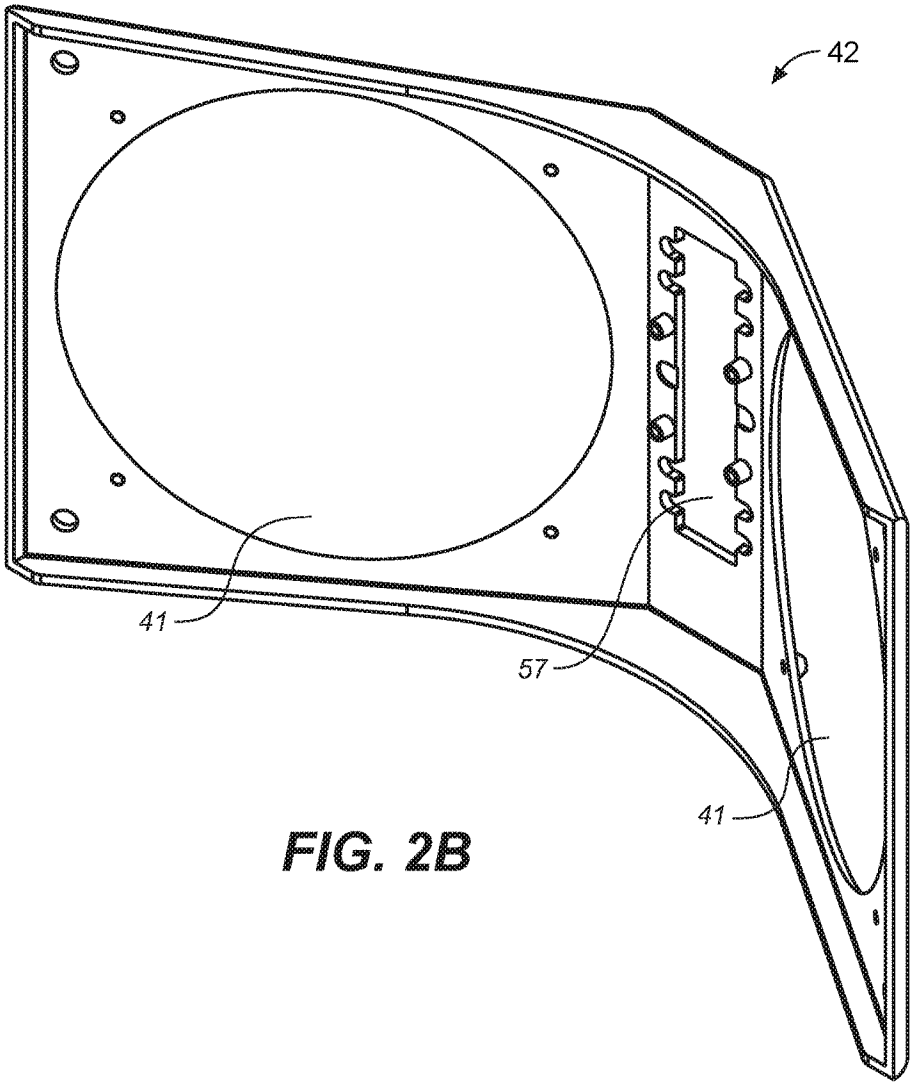
FIG. 2B is a top perspective view of the bezel frame used to mount the horn and cone drivers of the loudspeaker in the loudspeaker cabinet.
Figure 3:
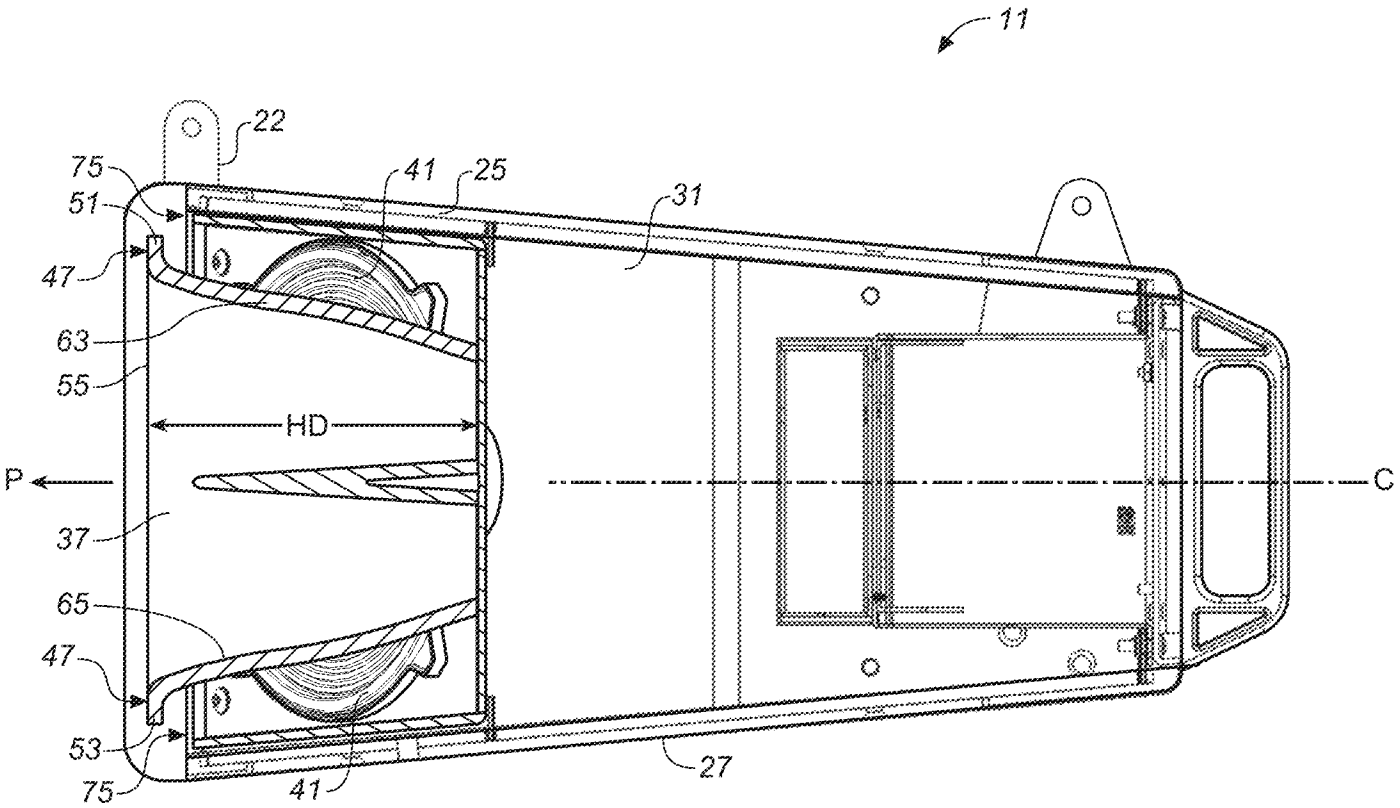
FIG. 3 is another cross-sectional view thereof taken along lines 3-3 in FIG. 1.
Figure 4:
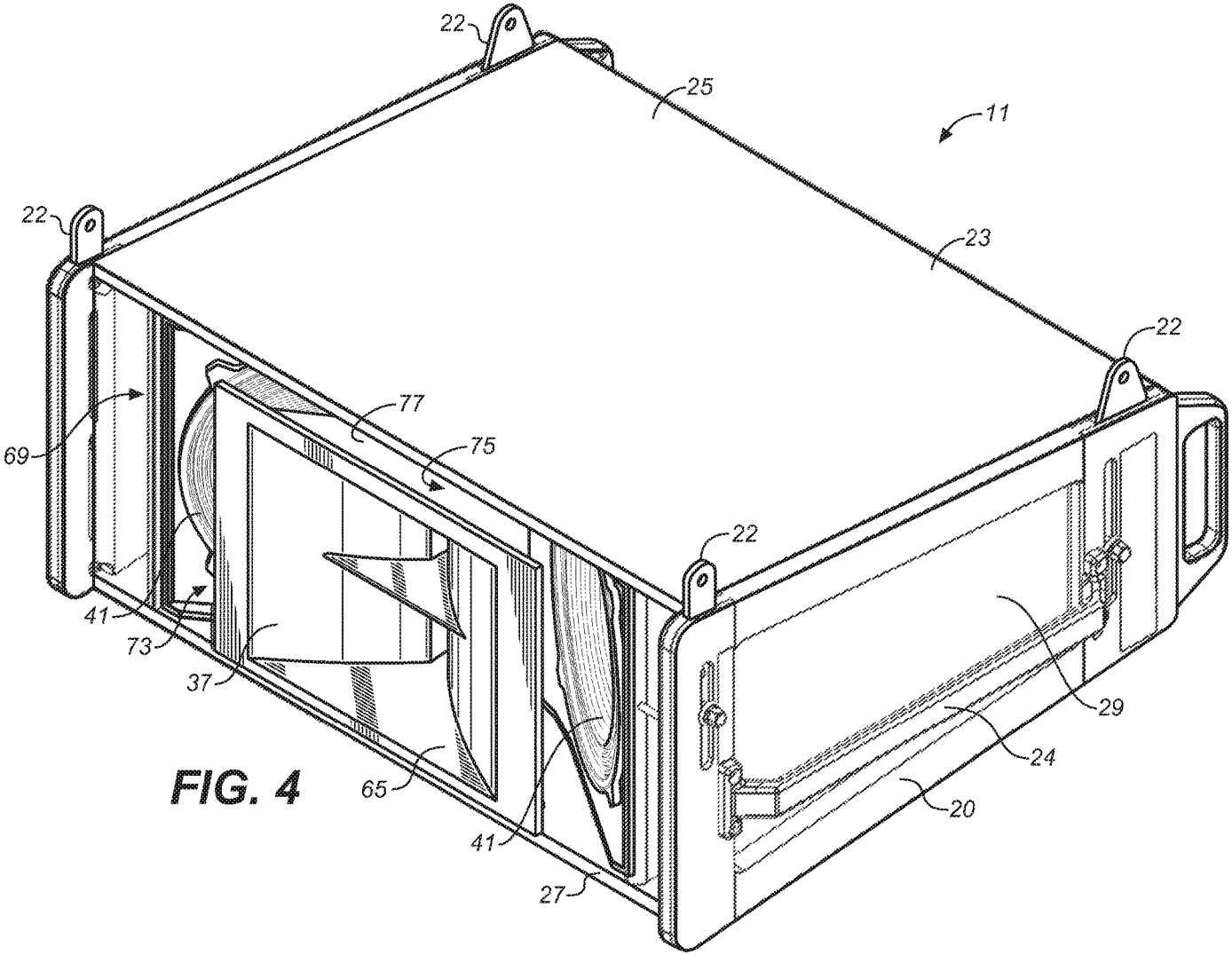
FIG. 4 is a top perspective view thereof.
Figure 5:
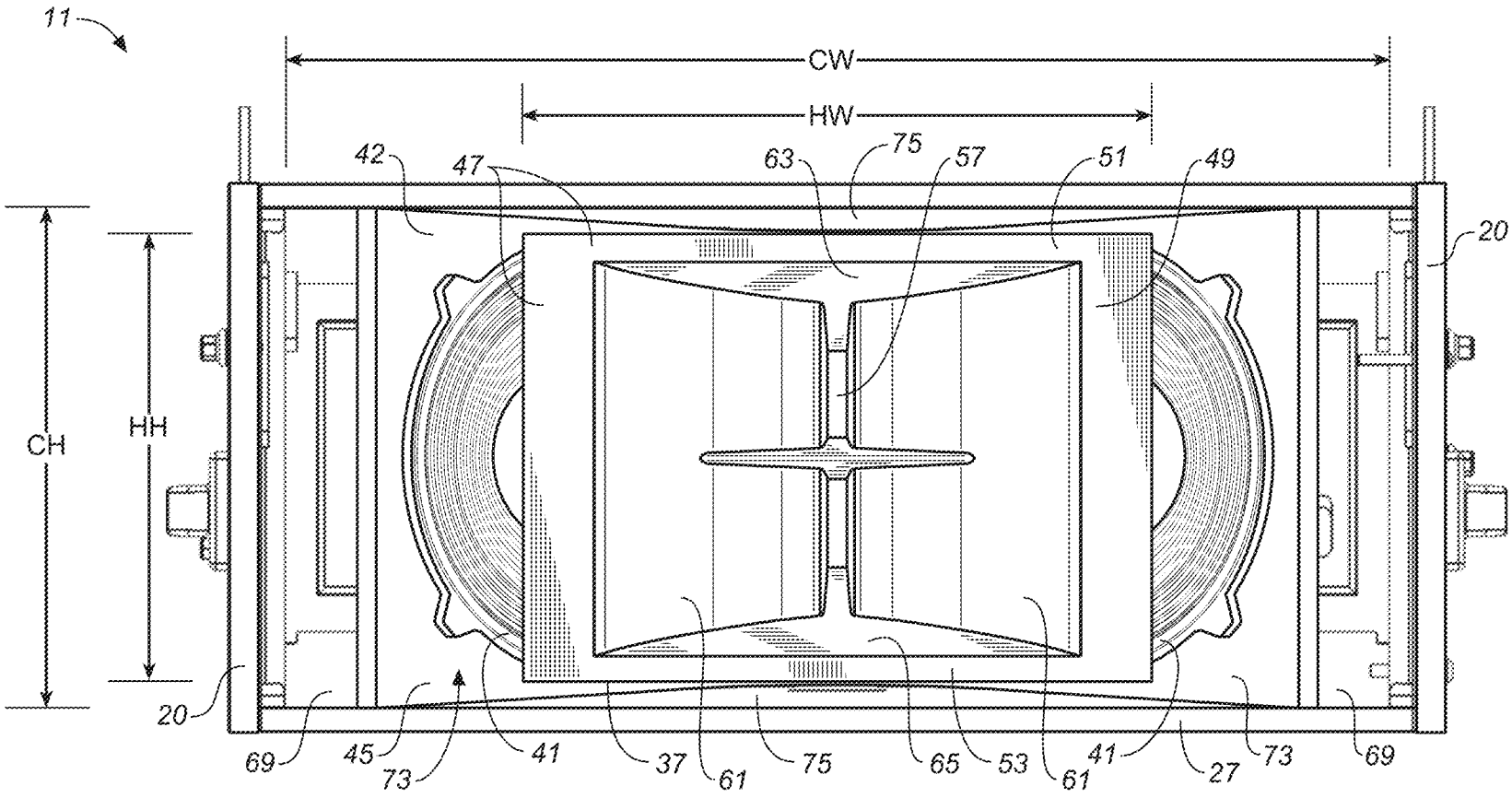
FIG. 5 is a front elevational view thereof.
Figure 5A:
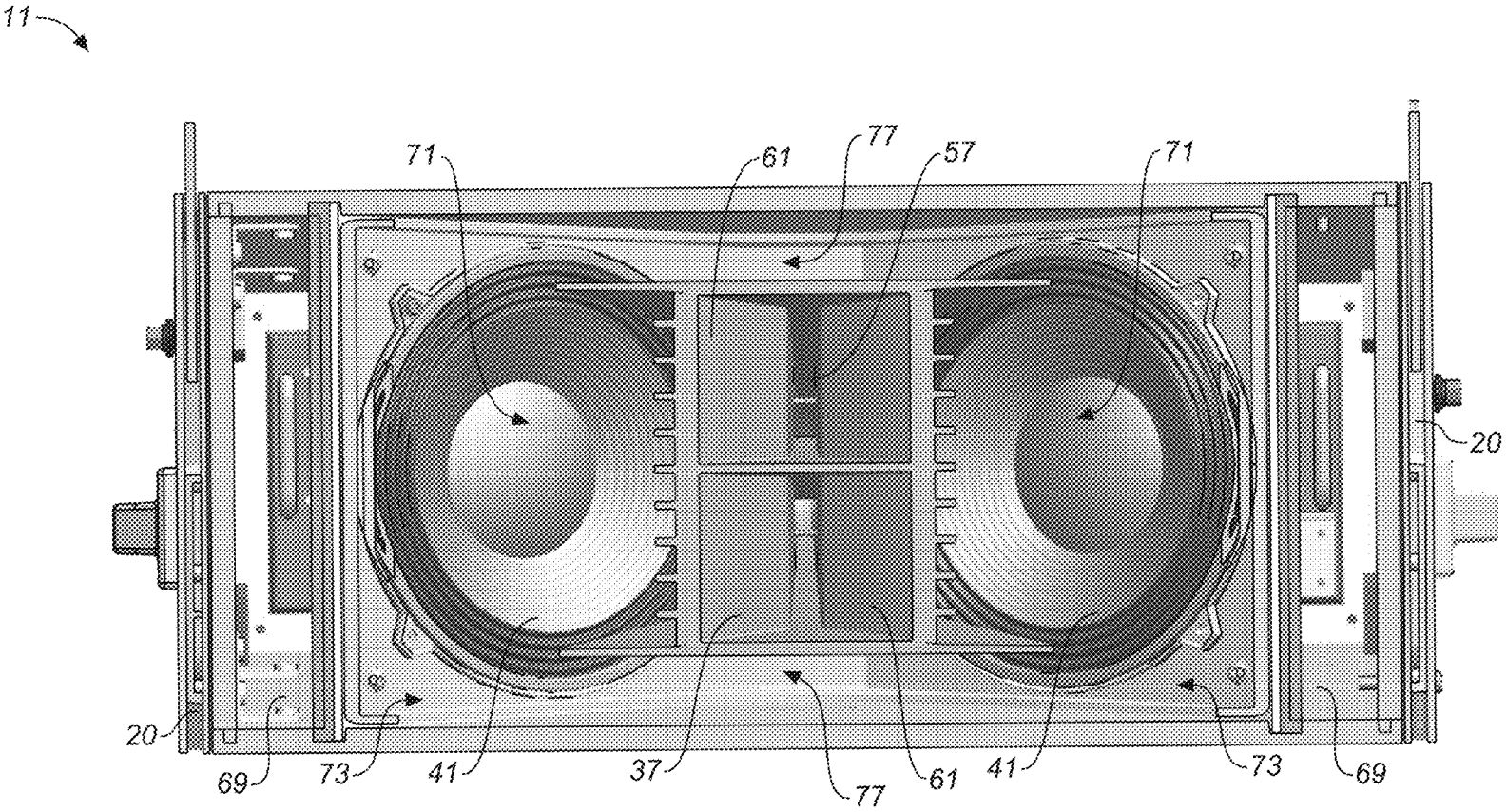
FIG. 5A is a cross-sectional view thereof taken along lines 5A-5A in FIG. 2.
Figure 5B:
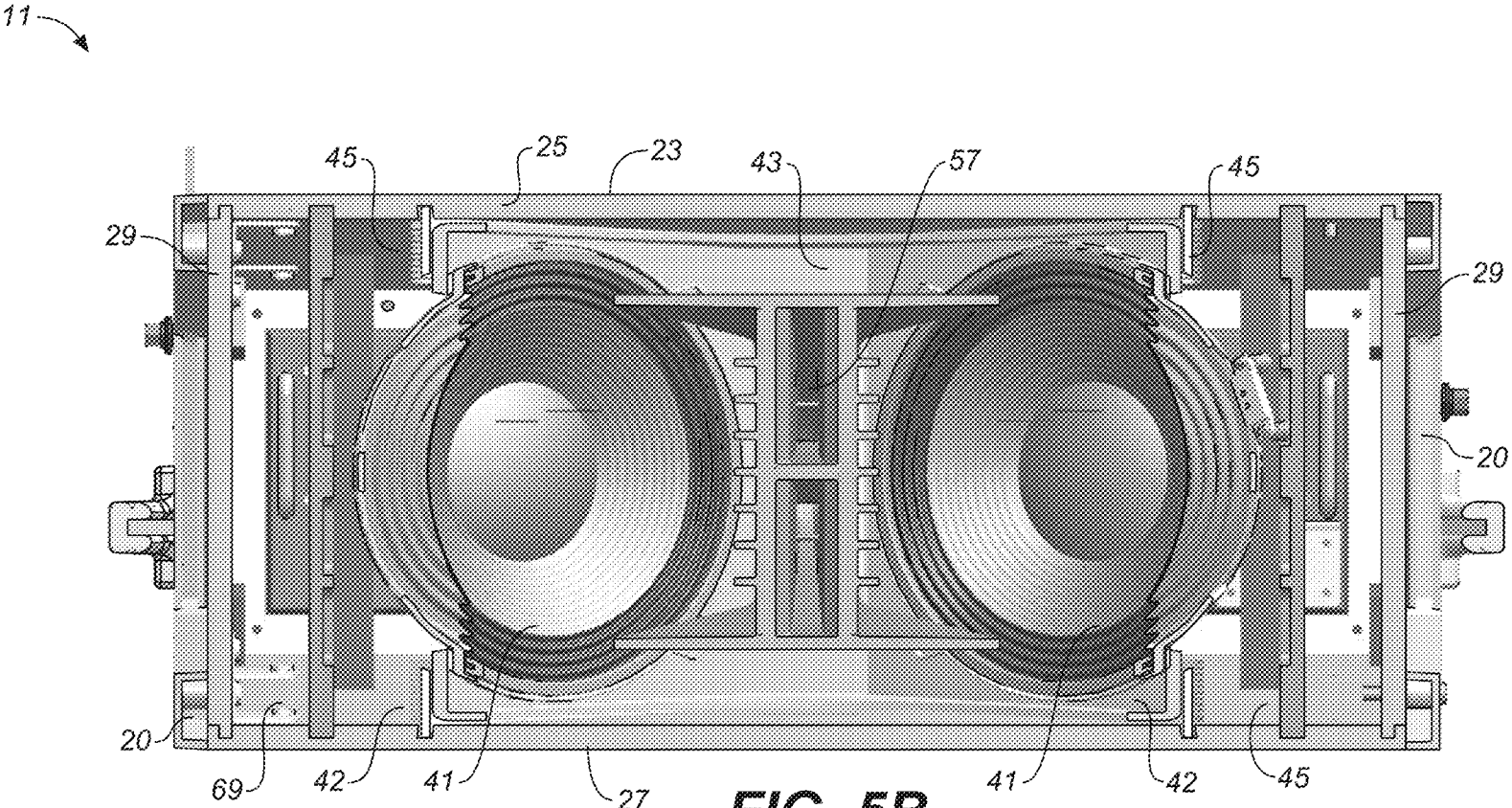
FIG. 5B is a cross-sectional view thereof taken along lines 5B-5B in FIG. 2.

Referring now to the drawings, FIG. 1 shows the front of an arrayable loudspeaker 11, which is seen to have a rectangular profile with top and bottom edges 13, 15 defining the short, or in the orientation shown in the drawings, vertical dimension or height of the loudspeaker. End edges 17, 19, in turn, define the loudspeaker's length, or as illustrated, its horizontal dimension. The short dimension, whether vertical or horizontal, will define the plane in which the loudspeakers can be arrayed. The front of the loudspeaker is covered with an acoustically transparent grill screen 21, which extends over the length of the loudspeaker and, in the vertical direction, preferably extends the entire height such that it wraps over the loudspeaker's top and bottom edges 13, 15. Providing a wrap-over grill screen at the top and bottom of the loudspeaker will allow for the propagation of sound from the front of the loudspeaker from regions where sound does not normally emanate.

FIGS. 2, 2A, 2B, 3, 4, 5, 5A and 5B reveal the internal components of the loudspeaker behind the grill screen. The loudspeaker cabinet 23 has a top wall 25, bottom wall 27, and side walls 29, all of which form an enclosure 31 for housing these internal components. The front 33 of the cabinet is open to provide a front opening 35 that can extend substantially the entire length and height of the cabinet. The center axis C of the cabinet passes through this front opening and provides an axis about which the horn and low frequency transducers hereinafter described are grouped. Side frames 20 mounted to the cabinet side walls 29 provide handles for lifting the loudspeaker and deployable linkages 22 used to link one speaker box to another in the vertical direction at desired splay angles to create a loudspeaker array.

The internal components of the loudspeaker include a horn 37, a high frequency transducer, suitably a compression driver 39, and a pair of low frequency transducers, suitably a matched pair of low frequency cone drivers 41. The horn and transducer components are supported in the enclosure in a special fixed spatial relationship to each other for achieving the performance benefits of the invention. The support structures include a horn mounting structure disposed on the center axis C of the enclosure behind the enclosure's front opening, and low frequency transducer mounting structures positioned in the enclosure behind the enclosure's front opening on opposite sides of the horn mounting structure. In the illustrated embodiment, the horn mounting structure and cone driver mounting structures are provided in the form of a single, suitably cast metal, bezel frame 42 having a flat center wall 43 parallel to the front opening of the loudspeaker cabinet, and bezel side walls 45 that angle forwardly toward the cabinet's front opening. The center wall 43 is sized and provided with suitable openings (not shown) to serve as a horn mounting structure; the horn can be mounted to this center wall such that the horn's propagation axis P is aligned with the center axis C of the loudspeaker cabinet. The angled bezel sidewalls serve as the cone driver mounting structures; by mounting the cone drivers to this angled sidewall the cone drivers are positioned in the cabinet enclosure on opposite sides of the horn at a predetermined forward facing angle relative to the propagation axis of the horn. The positioning of the cone drivers in relation to the horn along with the sizing of the horn in relation to the cabinet's front opening and vertical dimension combine to permit the desired beamwidth control to be achieved.

The horn has a front perimeter portion 47 formed by side perimeter edges 49, a top perimeter edge 51, and a bottom perimeter edge 53. This front perimeter portion defines the mouth end 55 of the horn, which is positioned at the open front of the loudspeaker. The horn further has an elongated throat end 57, and a bell portion 59 formed in part by flared sidewalls 61, which extend from the horn's throat end to its mouth end. The horn's top wall 63 and bottom wall 65 extend between these flared sidewalls and complete the bell portion. The compression driver 39 can be coupled to the back of the horn at its throat end 57 through a manifold (element 66 in FIG. 2A) such as disclosed in U.S. Pat. No. 6,668,969, so as to feed the throat end of the horn with a line of virtual acoustic power sources. The back of the compression driver, as well as the back of cone drivers 41, can be cooled by internal cooling fans 67, which circulate air within the enclosure.

As seen from the front of the loudspeaker, the front perimeter portion of the horn is sized such that it is smaller than the front opening 35 of the enclosure along each of its perimeter edges 49, 51, 53. At the sides of the horn, that is, to the outside of side perimeter edges 49 of the horn's mouth 55, the gap between the front perimeter portion of the horn and the front end edges 17 of the loudspeaker is sufficient to allow porting of the inside of the enclosure to atmosphere through side port openings 69 in the front of the enclosure and the coupling to atmosphere of the volume of air in the low frequency side chambers 71 between the forward facing and angled cone drivers 41 (and their support structures) and the backs 62 of the horn's flared sidewalls 61. These low frequency side chambers ("LF side chambers") are coupled to atmosphere through side chamber openings 73 which are located on the inside of port openings 69 between the horn and port openings. At the top and bottom of the horn, the size of the horn's front perimeter portion is such that air exit gaps 75 exist between the top and bottom perimeter edges 51, 53 of the horn's front perimeter portion and the top and bottom edges of the loudspeaker. These gaps and the air volumes behind the gaps play a critical role in the desired beamwidth control.

The air volumes behind top and bottom gaps 75 are created by the spaces between the top and bottom walls 63, 65 of horn 37 and the top and bottom walls 25, 27 of loudspeaker cabinet 23. These spaces are coupled to the LF side chambers 71 in front of the cone drivers 41 and act as low frequency (LF) exits channels, denoted by the numeral 77, above and below the horn for low frequency sound produced by the cone drivers.

The various components of the loudspeaker can be provided with the following exemplary specifications:

Loudspeaker cabinet front inside width (CW)—567 millimeters

Loudspeaker cabinet front inside height (CH)—257 millimeters

Outer width of horn mouth (HW)—322 millimeters

Outer height of horn mouth (HH)—229 millimeters

Horn Depth (HD)—159 millimeters

Low Frequency Transducers (41)—9-inch (228 mm) long-excursion cone drivers

High Frequency Transducer (39)—3-inch (76 mm) compression driver

To further describe how the LF side chambers 71 and LF exit channels 77 influence beamwidth in the non-arraying direction, it is seen that the low frequency cone drivers are mounted behind and to either side of the centrally mounted horn 37 and their radiating surfaces 79 are mostly obscured by the large flared side walls 61 of the horn. In conventional configurations, the side walls of the horn create solid baffles that direct the output of each individual cone around the side of the horn. This creates two distinct low frequency sources separated by the width of the horn. If the horn is wide enough, the cone drivers will exhibit significant pattern narrowing and possibly off-axis lobing at mid-frequencies below the crossover to the horn. In medium coverage loudspeakers this pattern narrowing can be beneficial. But if wide coverage is desired it can be problematic and can result in uneven frequency and phase response in the horizontal coverage plane.

In the loudspeaker described herein, a portion of the cone drivers' acoustic outputs is combined and directed through the LF exit channels 77 above and below the horn. The acoustic output from these central channels combined with the acoustic output emanating from the sides of the horn creates a continuous low-mid frequency source which maintains the nominal beamwidth angle over a substantial portion of the low-mid frequency range of the loudspeaker. The benefits of separate low frequency sources are retained since a substantial portion of the cone driver output is directed around the sides of the horn. Yet the drawbacks are eliminated since the remainder of the cone driver output radiates from the central area that is normally blocked by the horn. This is achieved without compromising the size and shape of the horn or the integrity of the horn walls.

The volume of the LF side chambers is suitably tuned to maximize efficiency in the low frequencies while maintaining useable response up to the crossover frequency. Too great a volume will cause premature roll-off of the cone driver response below the crossover frequency. Too small a volume will sacrifice efficiency.

The relative volumes of LF side chambers 71 and LF exit channels 77 are important. The volume of the LF side chambers should ideally comprise approximately 75% of the total air volume of the cabinet between the cones and the front of the cabinet, not including the volume taken up by the horn, that is, the combined volume of the LF side chambers and the LF exit channels. Thus, the volume of the LF exit channels is ideally approximately 25% of this total air volume. The mouth area of the LF exit channels at air exit gaps 75 above and below the horn is preferably at least about 25% of the total surface area of the radiating surfaces 79 of the cone drivers. The depth of the LF exit channels measured from the exit gaps 75 at the front of the horn to the back of the channels at the center wall 43 of the mounting bezel frame 42 preferably will not exceed about 30% of the wavelength at the crossover frequency. The center-to-center spacing of the cone drivers preferably will not exceed about 50% of the wavelength at the crossover frequency. The preferred angle of the cone drivers relative to the plane of the front of the enclosure is about 33 degrees.

It is estimated that the preceding figures may vary by up to roughly +/−20% without unacceptable loss of the desired beamwidth control. The following approximate ranges are contemplated:

- Air volume of the LF side chambers—about 80% down to about 70% of total air volume with a corresponding range of about 20% to about 30% for the air volume of the LF exit channels.
- Mouth area of the LF exit channels at air exit gaps—between about 20% and about 30% of the total surface area of the radiating surfaces of the cone drivers.
- Depth of the LF exit channels—no greater than about 35% of the wavelength at the crossover frequency.
- Center-to-center spacing of the cone drivers—no greater than about 60% of the wavelength at the crossover frequency.
- Angle of the cone drivers relative to the plane of the front of the enclosure—about 27 degrees to about 39 degrees.

The dimensions of the oversized horn mouth provide pattern control in both planes down to the lowest possible frequency (crossover). In the current embodiment, the width of the horn is made very large in order to maintain the nominal horizontal beamwidth down to crossover. The height of the horn is also maximized for vertical pattern control while still allowing space for the small LF exit channels to terminate above and below it. The horn design creates an overall radiation pattern that maintains the nominal beamwidth angle over a substantial portion of the high frequency range.

A secondary benefit of the LF exit channels 77 relates to the physical size of the loudspeaker. In order to fit the oversized cones in a relatively narrow enclosure, they must be angled back into the cabinet in a "clamshell" configuration. This increases output at some frequencies and reduces it at others. When a large horn is placed in front of clam-shelled cones it has the potential to further reduce output at frequencies where the wavelength approaches ¼ to ½ the largest dimension of the horn. The LF exit channels alleviate this issue by providing a secondary path for some of the cones' output at those frequencies that would otherwise be significantly reduced in level.

A separate aspect of the invention provides further improvement to horizontal directional control in a frequency range above crossover (sometimes referred to herein as the "affected frequency range"), which typically will be in a critical range of 1-2 kHz. The LF side chambers 71 on either side of the horn 37 can cause beamwidth distorting effects, and in particular a pronounced narrowing of the beamwidth centered above crossover, for example, at about 1.4 kHz. Due to diffraction that occurs at the mouth of the horn and to the size and shape of the LF side chambers, some residual off-axis acoustic energy produced by the horn centered around 1.4 kHz is captured in the LF side chambers and reflected back. The delayed arrival of this reflected energy can lead to destructive interference in the horn's off-axis energy resulting in a narrowing of the loudspeaker's coverage pattern at this frequency.

Figure 6A:
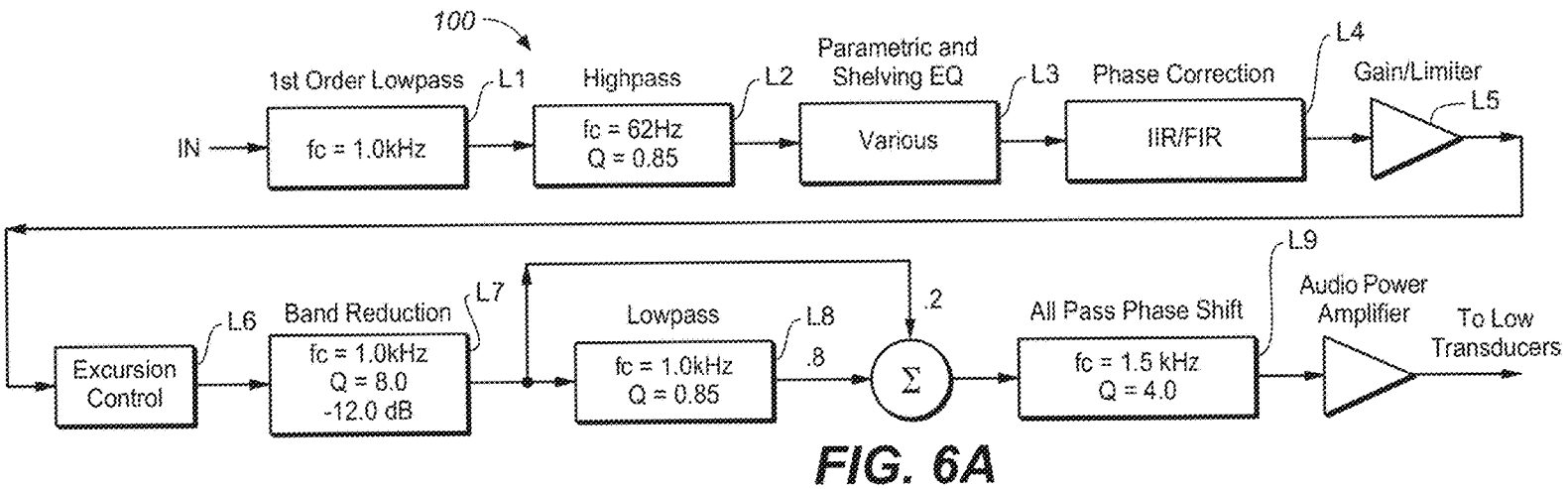
FIGS. 6A and 6B are block diagrams of the high and low frequency channels of an exemplary signal processing circuit for the loudspeaker shown in the foregoing figures.
Figure 6B:
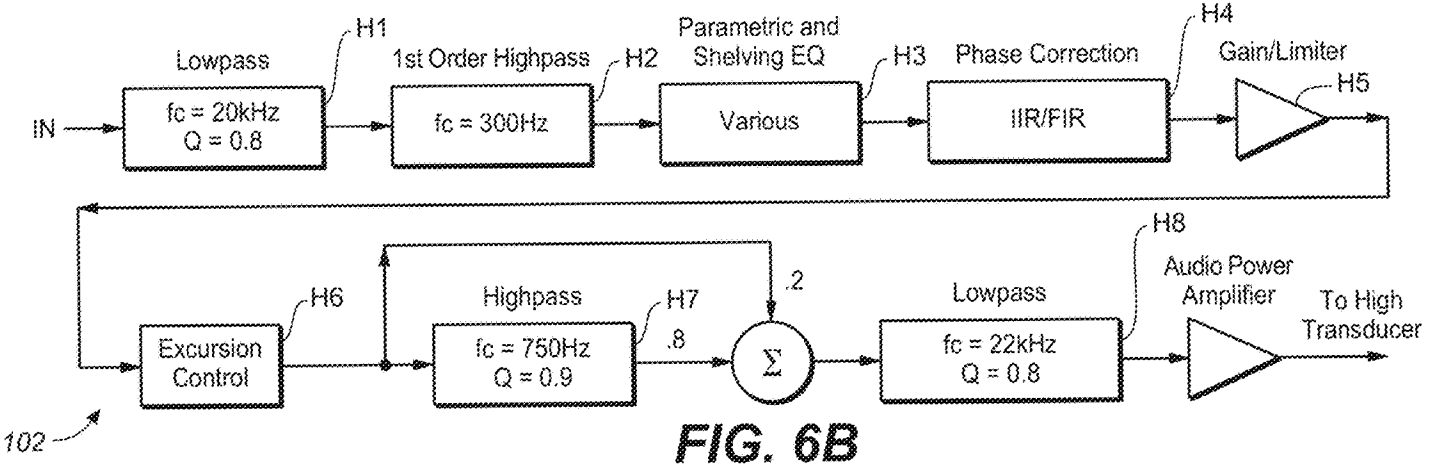
Figure 8:
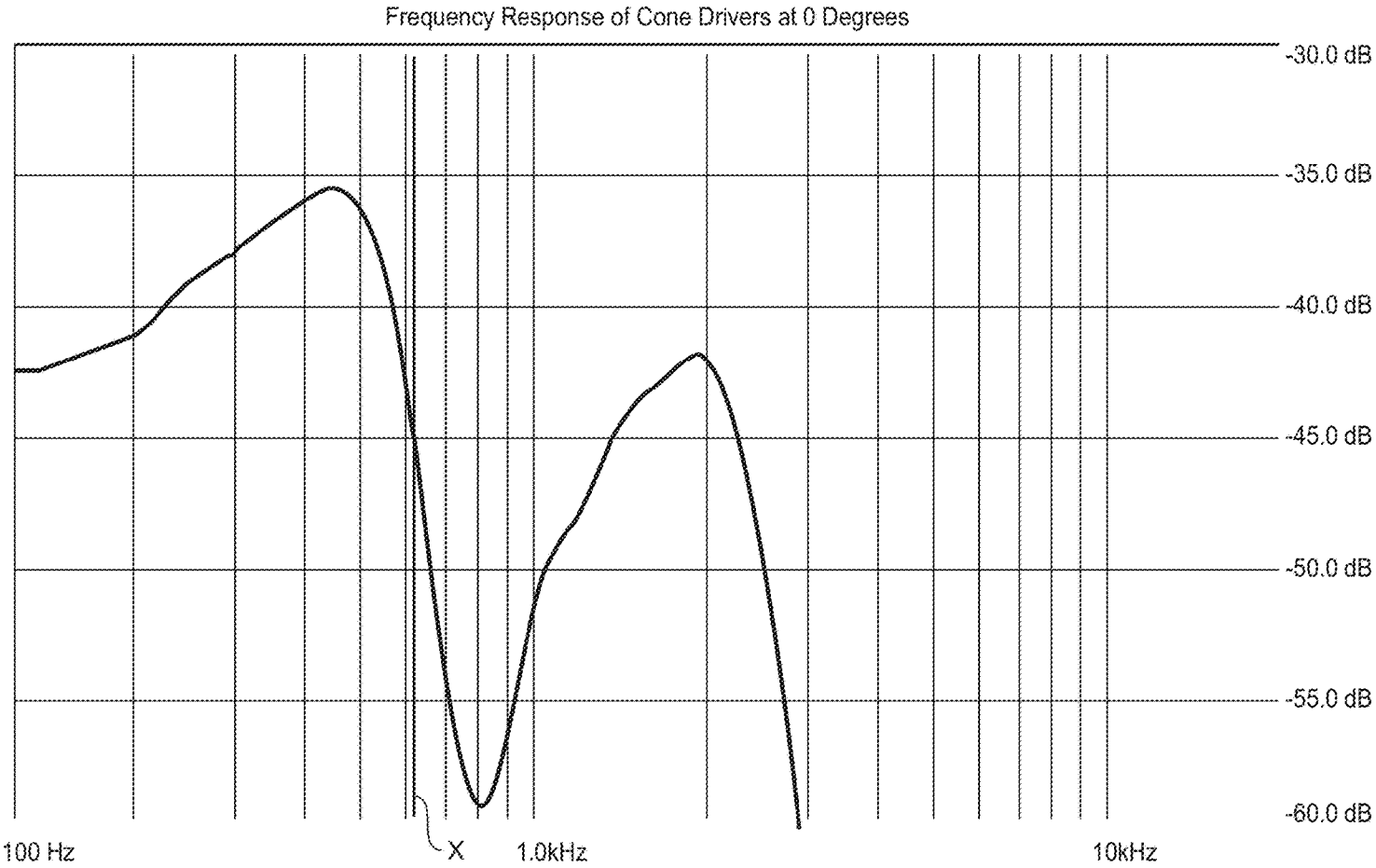
FIG. 8 is a graph of the unprocessed on-axis frequency response of the cone drivers of the loudspeaker illustrated in FIGS. 1-5.
Figure 9:
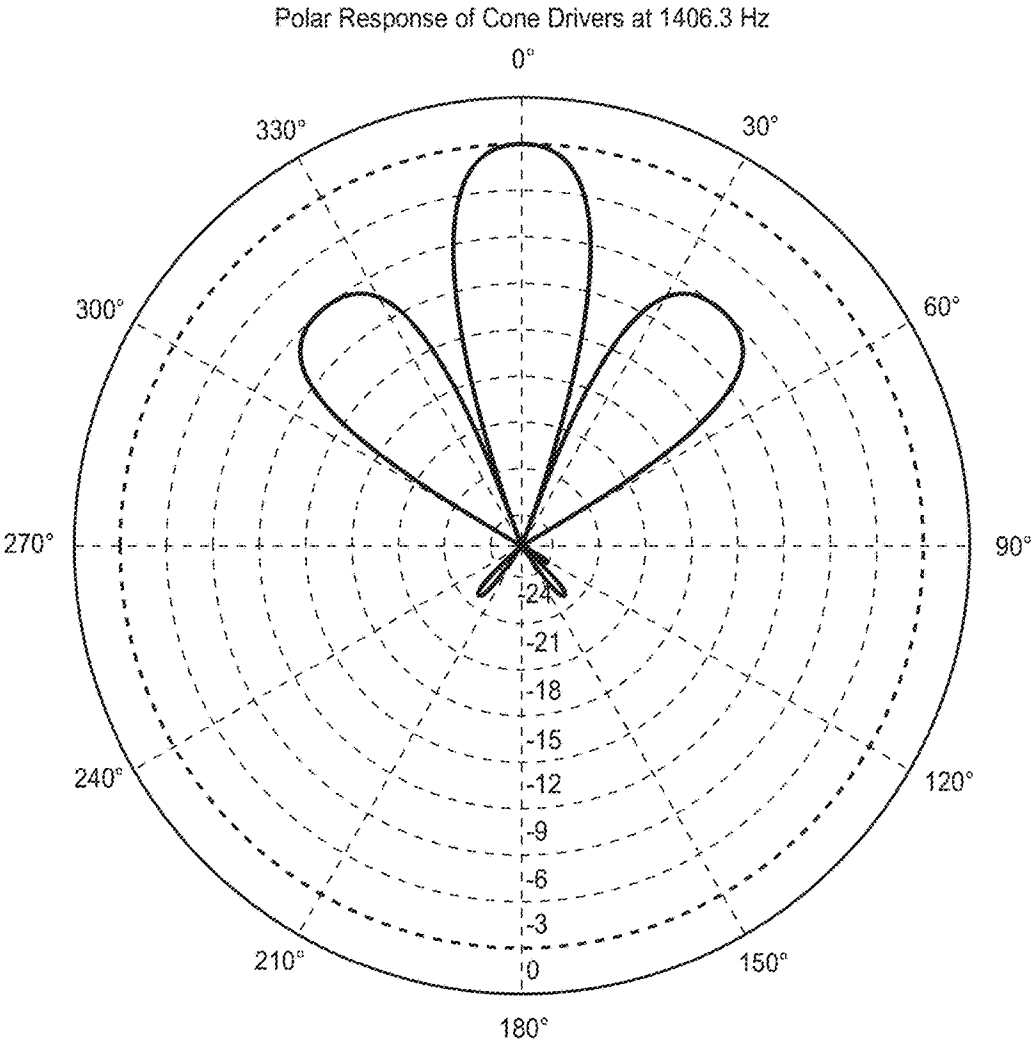
FIG. 9 is a polar graph showing the polar response of the cone drivers of the loudspeaker illustrated in FIGS. 1-5 at about 1.4 kHz showing small side lobes.

A special correction circuit means, such as the correction circuit shown in FIGS. 6A and 6B, can be included in the loudspeaker's signal processing to solve this issue by taking advantage of the particular acoustic behavior of the cone drivers in the illustrated horn-cone configuration. Although the illustrated cone driver configuration naturally rolls off much of the cone drivers' acoustic output above crossover (for example, at 625 Hz), a small amount of the cone drivers' acoustic energy still emanates off-axis above crossover. This phenomenon is illustrated in FIGS. 8 and 9. FIG. 8 shows the frequency response of the cone drivers 41 (alone and with no additional signal processing) in horn-cone configuration of the illustrated loudspeaker 11. It is seen that the frequency response of the cone drivers rolls off in the region of the crossover frequency denoted by the letter X, but then exhibits a bump between 1-2 KHz, that is, precisely within the frequency range of the residual horn energy captured and reflected by the LF side chambers 71. FIG. 9 is a polar graph that illustrates the on-axis (0 degree) energy produced by the cone drivers at roughly 1.4 kHz and the presence of off-axis side lobes at this frequency, that is, at a frequency where the horn energy reflected from the LF side chambers is found to occur. The off-axis acoustic energy produced by the cone drivers can advantageously be used to cancel out the coverage pattern narrowing effects of the residual horn energy that reflected from the LF side chambers, but only if acoustic energy produced by the cone drivers is to some extent preserved within the desired frequency range.

In accordance with the separate improvement aspect of the invention, rather than using a conventional steep, high-order electronic low pass to completely roll off the cone driver output above crossover, more gradual filters are used which allow both a proper acoustic crossover to the horn and the harnessing of the off-axis cone driver energy within the critical frequency range of 1-2 kHz. An all-pass filter is used to manipulate the phase of this off-axis cone energy such that, through destructive interference, it substantially cancels the delayed off-axis horn energy captured by the LF side chambers that would otherwise be released to cause excess beamwidth narrowing in the horizontal plane.

An exemplary correction circuit is now described with reference to FIGS. 6A and 6B. The illustrated correction circuit is seen to include a low channel 100 shown in FIG. 6A and a high channel 102 shown in FIG. 6B. Both channels incorporate elements of the crossover circuit required to divide the audio input signal between the loudspeakers' high and low frequency transducers (compression drivers 39 and cone drivers 41 shown in FIGS. 1-5). The crossover function is provided by several elements of the illustrated correction circuit, including the first order low-pass and high-pass filters L1 and H2 in, respectively, the low and high channels of the circuit, acting together with parametric and shelving EQ (L4 and H3) and other circuit filters such as the band-pass filters (L7) for band reduction and $2^{nd}$ order elliptic low-pass and high-pass filters (L8 and H7). The stop band ripple produced by the elliptic filter (L8) in the low channel can advantageously provide a bump in acoustic energy in a desired frequency range in the stop band. Overall, this filter scheme provides for the desired relatively gradual roll-off of the cone drivers to allow the cone drivers to produce sufficient acoustic energy within the 1-2 kHz range for purposes of canceling residual acoustic energy captured by LF side chambers 41.

With further reference to FIGS. 6A and 6B, the high-pass filter (L2) and low-pass filter (H8) provide attenuation outside of the audio band, and excursion control blocks (L6 and H6) provide protection for the low and high frequency transducers. Beamwidth correction at 1.4 kHz can be provided by elliptic filters (L8 and H7), and gain structuring and dynamic level control by the gain/limiters op amps (L5 and H5). Phase correction to accomplish a flat phase response is achieved by means of the phase correction blocks (L4 and H4), which can be implemented by FIR filters or a string of IIR all-pass filters.

As to the phase shift necessary to allow for canceling through destructive interference of the residual acoustic energy from the horn captured in LF side chambers 41, in the illustrated correction circuit this phase shift is achieved by block L9 in the low frequency channel. This block can be implemented by an all-pass filter centered in the affected frequency region, in this case at 1.5 kHz. Suitably this is a $2^{nd}$ order all-pass having a Q of 4.0.

It will be understood that the correction circuit illustrated in FIGS. 6A and 6B and above-described could be implemented by either analog circuits or by digital signal processing. The filter parameters shown in FIGS. 6A and 6B are exemplary parameters for the exemplary loudspeaker described herein, which include the dimensions set forth above. Designing a correction circuit to meet the criteria set forth herein for a loudspeaker in accordance with the invention that has other component dimensions and characteristics would be within the skill of persons of ordinary skill in the art.

Figure 7:
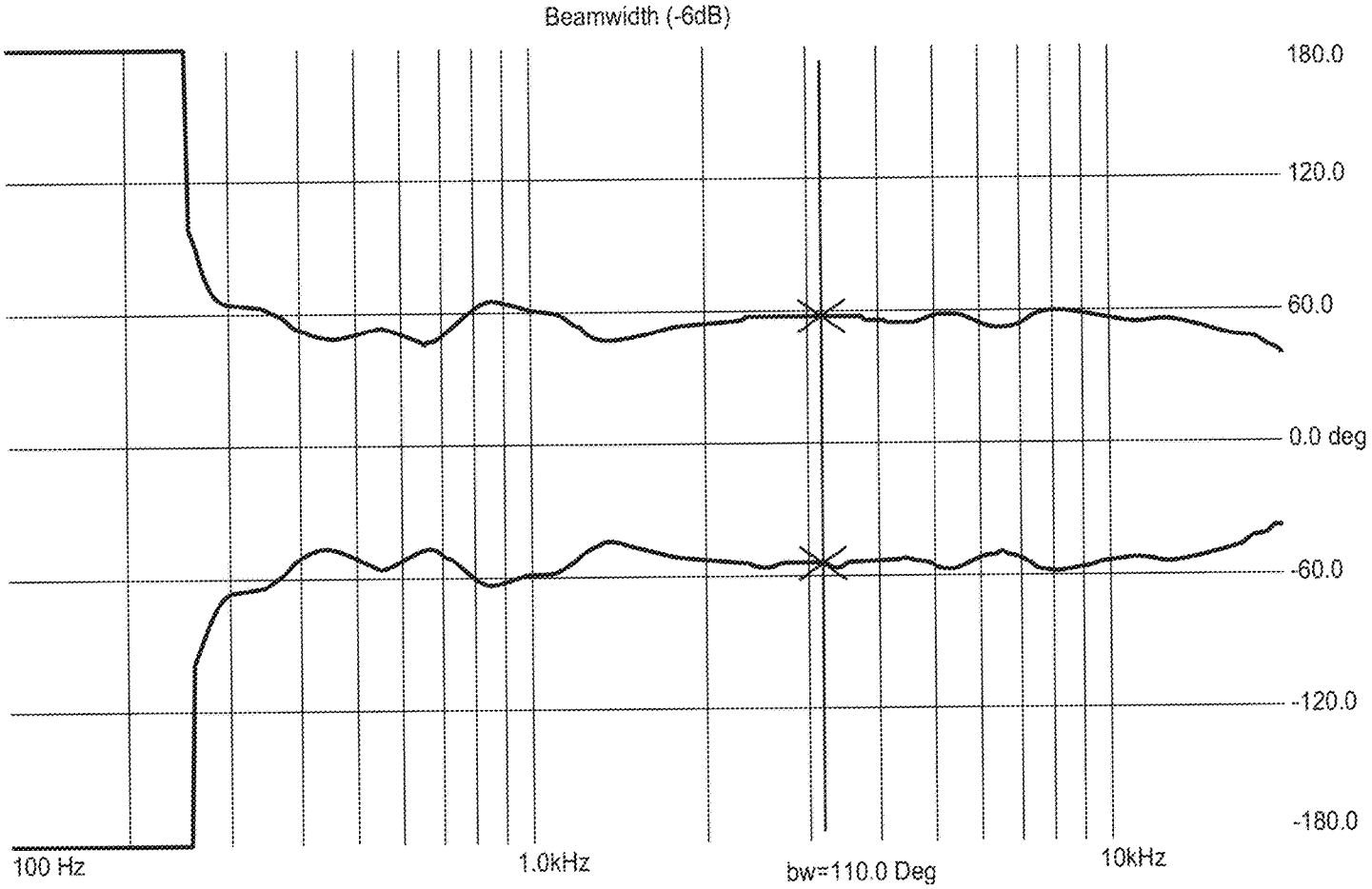
FIG. 7 is a graph of measured horizontal −6 db beamwidth of a loudspeaker in accordance with the invention over the loudspeaker's operating frequency range.
Figure 10:
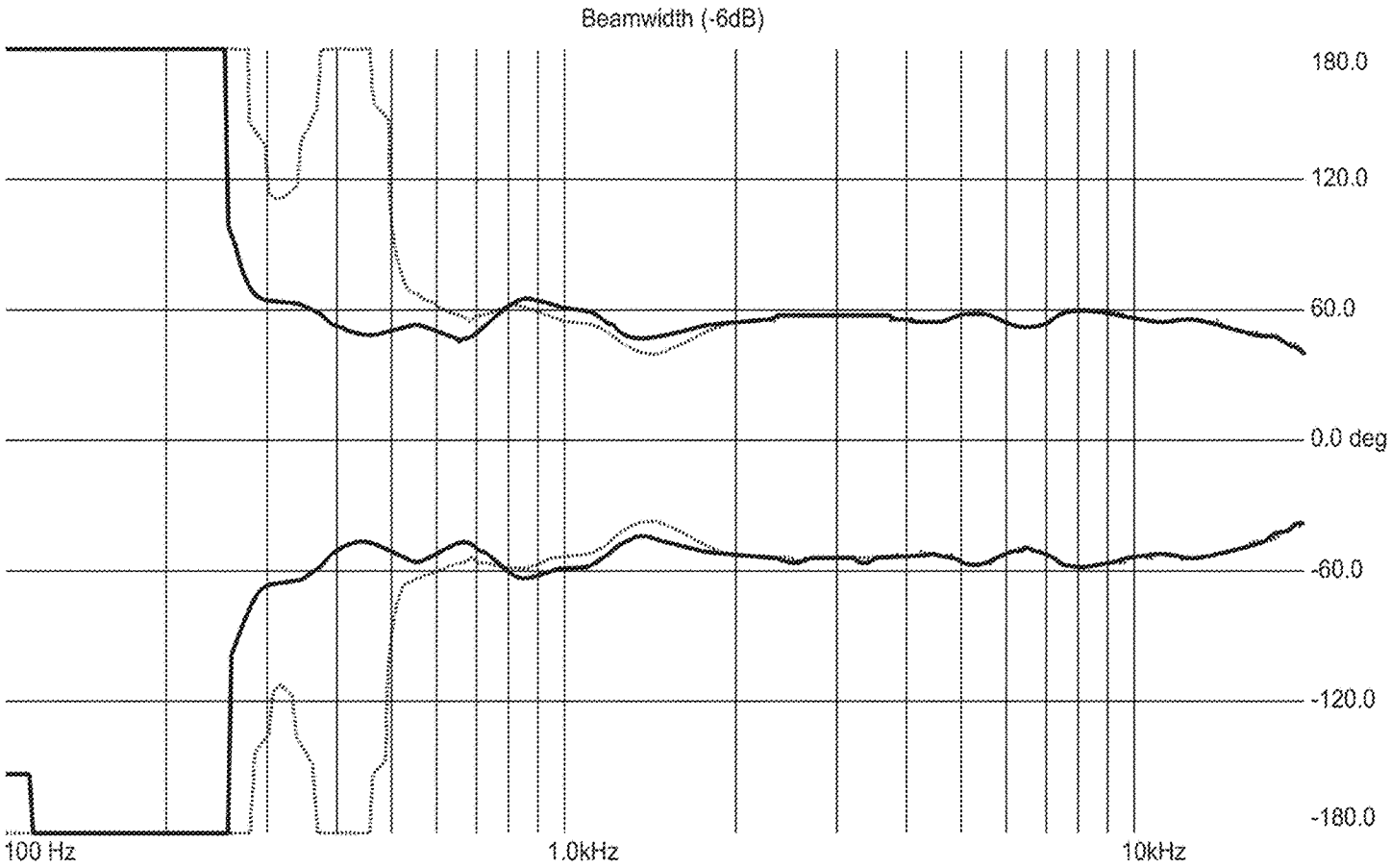
FIG. 10 is a graph of measured horizontal −6 dB beamwidth of a loudspeaker as shown in FIG. 7 over the loudspeaker's operating frequency range as compared to the measured beamwidth of the horn alone.

With the improvements in beamwidth control provided with the correction circuit described above and illustrated in FIGS. 6A and 6B, horizontal −6 dB beamwidth with $3^{rd}$-octave frequency smoothing is 110 degrees+/−20 degrees from 300 Hz-18 kHz. The graph in FIG. 7 shows these measured results. The graph in FIG. 10 shows the graph of FIG. 7 with the addition of dotted lines showing the measured beamwidth of the horn alone. The above-described narrowing of the coverage pattern at 1.4 KHz with the horn alone can be seen in this figure.

While an embodiment of the present invention has been described in considerable detail in the forgoing specification and accompanying drawings, it will be understood that it is not intended that the invention be limited to such detail unless expressly indicated. Other embodiments of the invention not expressly disclosed herein would be readily apparent to persons skilled in the art from this disclosure.

We claim:

1. An arrayable loudspeaker comprising:

a cabinet having top, bottom and side walls forming an enclosure and further having a front with a front opening and a center axis passing through said front opening, a horn mounting structure disposed on said center axis of said enclosure behind the front opening thereof, a horn for a high frequency transducer, said horn having a front perimeter portion defining a mouth end, a throat end, flared sidewalls extending from said throat end to said mouth end, and a top wall and a bottom wall extending between said sidewalls, and further having an axis extending from the throat end of the horn through the horn's mouth end which defines a propagation axis, the front perimeter portion of the horn including side perimeter edges, a top perimeter edge and a bottom perimeter edge, said horn being mounted to the horn mounting structure in said enclosure such that the horn's propagation axis substantially aligns with the center axis of said enclosure, and such that the mouth end of the horn is positioned at the front opening of said enclosure, the mouth end of said horn being smaller than the front opening of said enclosure such that side chamber openings are created at the front opening of the enclosure adjacent the mouth end of the horn, and such that top and bottom gaps are created at the front of the enclosure above and below the top and bottom perimeter edges of the horn's front perimeter portion, a high frequency transducer mounted to the throat end of the horn, low frequency transducer mounting structures positioned in said enclosure behind the front opening thereof on opposite sides of said horn mounting structure, and at least one forward facing low frequency transducer mounted to each of said low frequency transducer mounting structures such that the low frequency transducers are positioned in said enclosure on opposite sides of said horn at a predetermined inward and forward facing angle relative to the propagation axis of the horn, wherein each forward facing low frequency transducer faces inwardly toward the propagation axis of the horn so as to face a flared sidewall of the horn and one of said side chamber openings at the front of the cabinet, wherein low frequency side chambers containing a volume of air are formed between the forward and inwardly facing low frequency transducers and the flared sidewalls of the horn, said low frequency side chambers being coupled to atmosphere through the side chamber openings at the front opening of the enclosure adjacent the mouth end of the horn, and wherein low frequency exit channels are formed above the top wall of the horn and below the bottom wall of the horn, said low frequency exit channels having the following characteristics:

they have a volume for containing a volume of air, they extend from about the horn's support structure to the gaps at the front of the enclosure above and below the top and bottom perimeter edges of the horn's front perimeter portion, they couple to said low frequency transducer side chambers, and they couple to atmosphere through the top and bottom gaps above and below the top and bottom perimeter edges of the horn's front perimeter portion.

2. The arrayable loudspeaker of claim 1 wherein said low frequency transducers are disposed in said enclosure at a forward facing angle of between about 27 degrees and about 39 degrees.

3. The arrayable loudspeaker of claim 1 wherein said low frequency transducers are disposed in said enclosure at a forward facing angle of about 33 degrees.

4. The arrayable loudspeaker of claim 1 wherein the air volume of the low frequency exit channels comprises between about 20% to about 30% of the combined air volume of the low frequency side chambers and low frequency exit channels.

5. The arrayable loudspeaker of claim 1 wherein the air volume of the low frequency exit channels comprises approximately 25% of the combined air volume of the low frequency side chambers and low frequency exit channels.

6. The arrayable loudspeaker of claim 1 wherein said low frequency transducers are cone drivers, and wherein each of said cone drivers has a center.

7. The arrayable loudspeaker of claim 6 wherein said low frequency transducers receive audio signals at and below a crossover frequency and wherein the cone drivers on opposite sides of the horn have a center-to-center spacing no greater than about 60% of the signal wavelength at the crossover frequency.

8. The arrayable loudspeaker of claim 6 wherein said low frequency transducers receive audio signals at and below a crossover frequency and wherein the cone drivers on opposite sides of the horn have a center-to-center spacing no greater than about 50% of the signal wavelength at the crossover frequency.

9. The arrayable loudspeaker of claim 1 wherein said low frequency transducers receive audio signals at and below a crossover frequency and wherein the depth of the top and bottom low frequency exit channels measured from about the horn's support structure to the gaps at the front of the enclosure above and below the top and bottom perimeter edges of the horn's front perimeter portion is no greater than about 35% of the signal wavelength at the crossover frequency.

10. The arrayable loudspeaker of claim 1 wherein said low frequency transducers have radiating surfaces, wherein the top and bottom gaps above and below the top and bottom perimeter edges of the horn's front perimeter portion form a mouth of the low frequency exit channels, and wherein said mouth has a mouth area and said mouth area is between about 20% to 30% of the total surface area of the radiating surfaces of the cone drivers.

11. The arrayable loudspeaker of claim 1 wherein said horn mounting structure and said low frequency transducer mounting structures are in the form of a single bezel frame having a flat center wall for said horn and angled bezel side walls for said low frequency drivers.

12. The arrayable loudspeaker of claim 1 wherein the operating frequency range of the loudspeaker includes a crossover frequency range wherein both the low frequency transducers and the high frequency transducers contribute to the acoustic output of the loudspeaker, and wherein the loudspeaker further comprises correction circuit means, including a crossover circuit, for the high and low frequency transducers, for compensating for beamwidth distorting effects within an affected frequency range above the crossover frequency range caused by residual acoustic energy propagated from the horn that is captured by and reflected from the low frequency side channels formed between the horn and low frequency transducers.

13. The arrayable loudspeaker of claim 12 wherein said correction circuit means includes filters selected and configured to produce a gradual roll-off of the low frequency transducers over and above the crossover frequency range to allow the low frequency transducers to produce sufficient acoustic energy within the affected frequency range to cancel residual acoustic energy captured by the low frequency side chambers.

14. The arrayable loudspeaker of claim 13 wherein said correction circuit means further includes means for shifting the phase of the acoustic output of the low frequency transducers within the affected frequency range.

15. The arrayable loudspeaker of claim 14 wherein the means for shifting the phase of the acoustic output of the low frequency transducers includes a $2^{nd}$ order all-pass filter centered within the affected frequency range.

16. An arrayable loudspeaker comprising:

a cabinet having top, bottom and side walls forming an enclosure and further having a front with a front opening and a center axis passing through said front opening, a horn mounting structure disposed on said center axis of said enclosure behind the front opening thereof, a horn for a high frequency transducer, said horn having a front perimeter portion defining a mouth end, a throat end, flared sidewalls extending from said throat end to said mouth end, and a top wall and a bottom wall extending between said sidewalls, and further having an axis extending from the throat end of the horn through the horn's mouth end which defines a propagation axis for sound produced by a high frequency transducer mounted to the throat end of the horn, the front perimeter portion of the horn including side perimeter edges, a top perimeter edge and a bottom perimeter edge, said horn being mounted to the horn mounting structure in said enclosure such that the horn's propagation axis substantially aligns with the center axis of said enclosure, and such that the mouth end of the horn is positioned at the front opening of said enclosure, the mouth end of said horn being smaller than the front opening of said enclosure such that side chamber openings are created at the front opening of the enclosure adjacent the mouth end of the horn, and such that top and bottom gaps are created at the front of the enclosure above and below the top and bottom perimeter edges of the horn's front perimeter portion, low frequency transducer mounting structures positioned in said enclosure behind the front opening thereof on opposite sides of said horn mounting structure, and at least one forward facing low frequency transducer mounted to each of said low frequency transducer mounting structures such that the low frequency transducers are positioned in said enclosure on opposite sides of said horn at a predetermined forward facing angle of between about 27 degrees and about 39 degrees relative to the propagation axis of the horn, wherein each forward facing low frequency transducer faces a flared sidewall of the horn and one of said side chamber openings at the front of the cabinet, wherein low frequency side chambers containing a volume of air are formed between the forward facing low frequency transducers and the flared sidewalls of the horn, said low frequency side chambers being coupled to atmosphere through the side chamber openings at the front opening of the enclosure adjacent the mouth end of the horn, and wherein low frequency exit channels are formed above the top wall of the horn and below the bottom wall of the horn, said low frequency exit channels having the following characteristics:

they have a volume for containing a volume of air, the air volume thereof comprises between about 20% to about 30% of the combined air volume of the low frequency side chambers and low frequency exit channels, they extend from about the horn's support structure to the gaps at the front of the enclosure above and below the top and bottom perimeter edges of the horn's front perimeter portion, they couple to said low frequency transducer side chambers, and they couple to atmosphere through the top and bottom gaps above and below the top and bottom perimeter edges of the horn's front perimeter portion.

17. The arrayable loudspeaker of claim 16 wherein said low frequency transducers receive audio signals at and below a crossover frequency and wherein the cone drivers on opposite sides of the horn have a center-to-center spacing no greater than about 60% of the signal wavelength at the crossover frequency.

18. The arrayable loudspeaker of claim 17 wherein said low frequency transducers receive audio signals at and below a crossover frequency and wherein the cone drivers on opposite sides of the horn have a center-to-center spacing no greater than about 50% of the signal wavelength at the crossover frequency.

* * * * *